US009339070B2

(12) United States Patent
Rendon

(10) Patent No.: US 9,339,070 B2
(45) Date of Patent: May 17, 2016

(54) FASHIONABLE ATTIRE ACCESSORIES

(71) Applicant: Kathryn Jeanne Rendon, Fallbrook, CA (US)

(72) Inventor: Kathryn Jeanne Rendon, Fallbrook, CA (US)

( * ) Notice: Subject to any disclaimer, the term of this patent is extended or adjusted under 35 U.S.C. 154(b) by 432 days.

(21) Appl. No.: 13/784,548

(22) Filed: Mar. 4, 2013

(65) Prior Publication Data

US 2013/0227763 A1 Sep. 5, 2013

Related U.S. Application Data

(60) Provisional application No. 61/634,654, filed on Mar. 5, 2012.

(51) Int. Cl.
*A41D 27/08* (2006.01)

(52) U.S. Cl.
CPC ..... *A41D 27/08* (2013.01)

(58) Field of Classification Search
CPC ..... A41D 27/08; A41D 27/20; Y10T 24/13; Y10T 24/1376
USPC ..... 24/3.1, 303
See application file for complete search history.

(56) References Cited

U.S. PATENT DOCUMENTS

| | | | | |
|---|---|---|---|---|
| 5,809,576 | A * | 9/1998 | Huston et al. | 2/247 |
| 6,035,449 | A * | 3/2000 | Galler et al. | 2/249 |
| 7,003,810 | B2 * | 2/2006 | Goldkind | 2/227 |
| 7,854,018 | B1 * | 12/2010 | Meske | A41H 27/00 2/160 |
| 7,980,012 | B2 * | 7/2011 | Peterson et al. | 40/1.5 |
| 2003/0029006 | A1 * | 2/2003 | Pelt et al. | 24/303 |
| 2007/0084080 | A1 | 4/2007 | Heiderer et al. | |
| 2009/0049719 | A1 * | 2/2009 | Compton et al. | 40/586 |
| 2009/0178173 | A1 * | 7/2009 | Schultz | 2/16 |
| 2012/0117715 | A1 * | 5/2012 | Weafer | 2/228 |
| 2013/0091620 | A1 * | 4/2013 | Randolph | 2/244 |
| 2013/0305428 | A1 * | 11/2013 | Rendon | 2/74 |

* cited by examiner

*Primary Examiner* — Robert J Sandy
*Assistant Examiner* — Rowland Do
(74) *Attorney, Agent, or Firm* — Donny K. Sampoma; Michael Cocchi; Amanda Wang

(57) ABSTRACT

Accessories use fasteners and fashionable pieces to supplement clothing, such as pants or shirts, as well as other articles of apparel, such as footwear or hats. The fasteners connect to such apparel using either magnets or clips. Then the fashionable pieces connect to the fasteners using non-permanent adhesives, allowing the fashionable pieces to be easily attached or removed from the apparel. This can allow a single article of apparel to have many different looks depending on how many different fashionable pieces are owned and used with the apparel.

4 Claims, 15 Drawing Sheets

FASHIONABLE ATTIRE ACCESSORIES

CLAIM OF PRIORITY

This application claims the benefit of priority from commonly owned U.S. Provisional Patent Application Ser. No. 61/634,654, entitled "Kabuki Boot Toppers" and filed on Mar. 5, 2012, which is fully incorporated herein by reference for all purposes.

BACKGROUND

1. Field of the Application

This application is directed to fashion accessories and more specifically to outfit complements that fasten to clothing by use of magnetic and clip fasteners to provide a fashionable decorative look.

2. Background of the Disclosure

Clothing and clothing accessories can be expensive and people are often limited in the quantity they can own. Often an article of apparel only allows the owner a single style, limiting the versatility of the article and the ability to wear it frequently with various fashion outfits. Also, if traveling, packing a large amount of different articles of clothing or accessories might be impractical.

It would be desirable to have the ability to change the look or style of an article of clothing in a quick, practical, and cost effective way. Others have attempted to provide pseudo boot toppers, using socks that fold over the upper part of boots. Although such designs may save costs, it is useful for only certain types of footwear, specifically boots. Further, using socks or stretchable bands may allow slippage and limit the owner in adjusting the topper depending upon the position and look desired.

Therefore, what is needed is a solution to at least some of these and other issues and/or disadvantages.

SUMMARY

In certain embodiments, an apparatus to accessorize apparel is disclosed that includes a fastener that removably attaches to the apparel using at least one magnet and a decorative portion that removably attaches to the fastener. The fastener can include a front side, the front side having an adhesive piece, and a back side, the back side having a material, wherein the at least one magnet is integrally attached near at least one end of the fastener. The decorative portion can include an exposed side, the exposed side having an ornamental design, and an inside, the inside having at least one adhesive strip.

In certain embodiments, an apparatus to accessorize apparel is disclosed that includes a fastener that removably attaches to the apparel using at least one clip and a decorative portion that removably attaches to the fastener. The fastener can include a front side, the front side having an adhesive piece; and a back side, the back side having a material, wherein the at least one clip is affixed near an end of the fastener. The decorative portion can include an exposed side, the exposed side having an ornamental design, and an inside, the inside having at least one adhesive strip.

DETAILED DESCRIPTION

Figure 1:
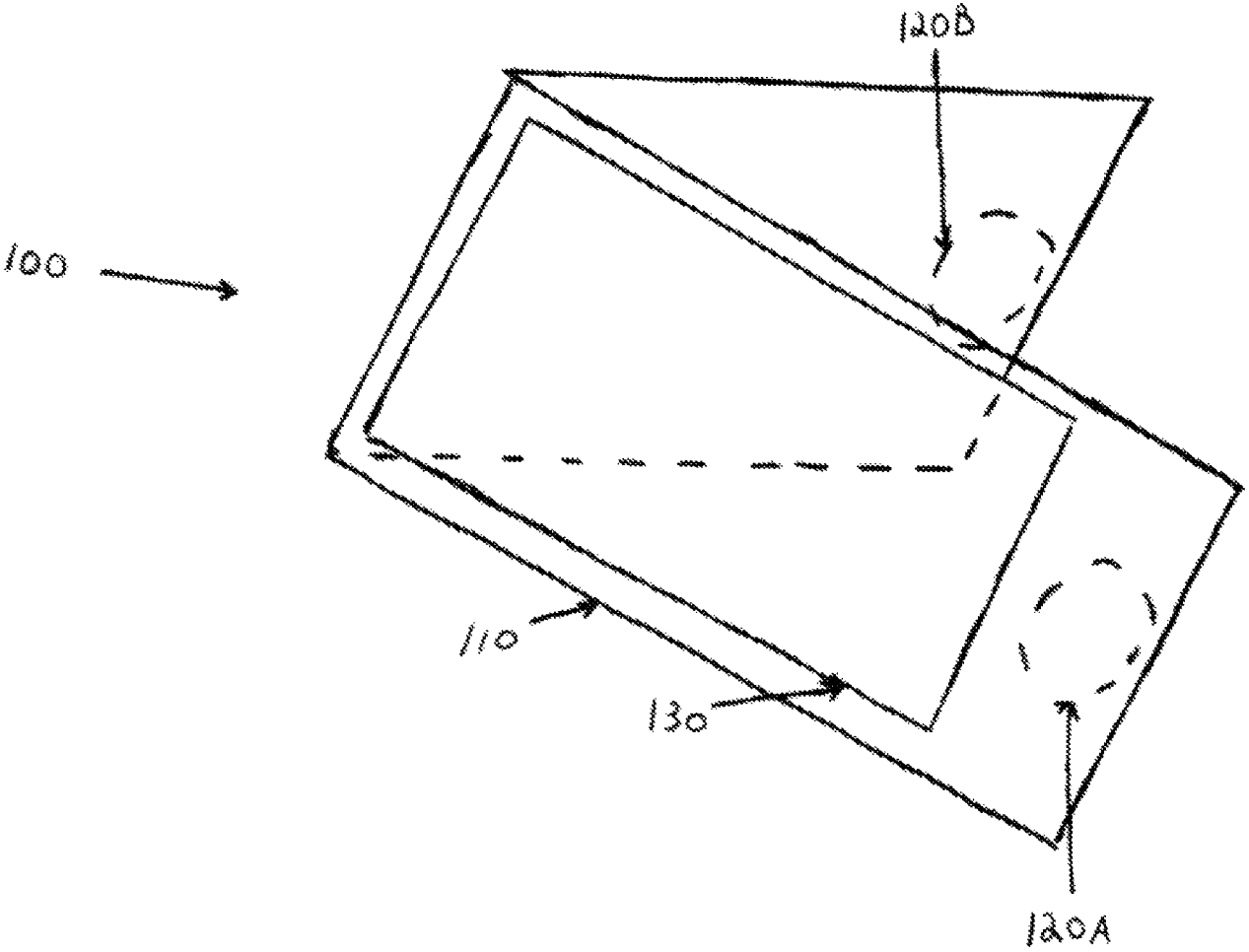
FIG. 1 illustrates an exemplary isometric view of a two-magnet bendable fastener according to certain embodiments.

For purposes of description herein, the terms "top", "bottom", "middle", "right", "left", "right", "vertical", "horizontal", and derivatives thereof shall relate to certain embodiments as oriented in FIG. 11 and described in further detail, below. However, it is to be understood that this application may assume various alternative orientations and step sequences, except if expressly specified to the contrary. It is also to be understood the following detailed description and claims (comprising specific devices and processes illustrated in the attached drawings as well as described in the following specification) is directed to certain embodiments. However, the disclosure can be embodied in a multitude of different ways as defined and covered by the claims and equivalents thereof. In this description, reference is made to the drawings wherein like parts are designated with like reference numerals throughout. Hence, specific dimensions and other physical characteristics relating to the embodiment disclosed herein are not to be considered as limiting, unless the claims expressly state otherwise.

FIG. 1 illustrates an exemplary isometric view of a two-magnet bendable fastener 100 according to certain embodiments. As shown in FIG. 1, bendable fastener 100 can include a general material 110 that can be made of a variety of materials, including leather, cotton, Nylon®, wool, felt, velvet, Velour®, rayon, acrylic or polyester. An adhesive piece 130 is attached to one-half of one side of bendable fastener 100. Adhesive piece 130 can be a variety of different types, including hook-and-loop, tape, or ties. Further, it is to be understood that adhesive piece 130 can vary in size and orientation. In FIG. 1, a magnet 120A, which is one part of a pair of magnets, is incorporated near one end of bendable fastener 100, with another magnet 120B, the other part of the pair of magnets, near the opposite end of bendable fastener 100. Further, magnets 120A and 120B can be any type of magnet, including neodymium, neodymium-iron-boron, samarium-cobalt, ferrite, or vinyl magnets; as well as vary in size and orientation. Also, one of magnets 120A and 120B could be replaced with a piece of magnetic material, such as iron and the like. In addition, bendable fastener 100 can include certain embodiments that incorporate more than one magnet at each end, including a differing number and combination of magnets and magnetic materials, as explained elsewhere herein.

Figure 8:
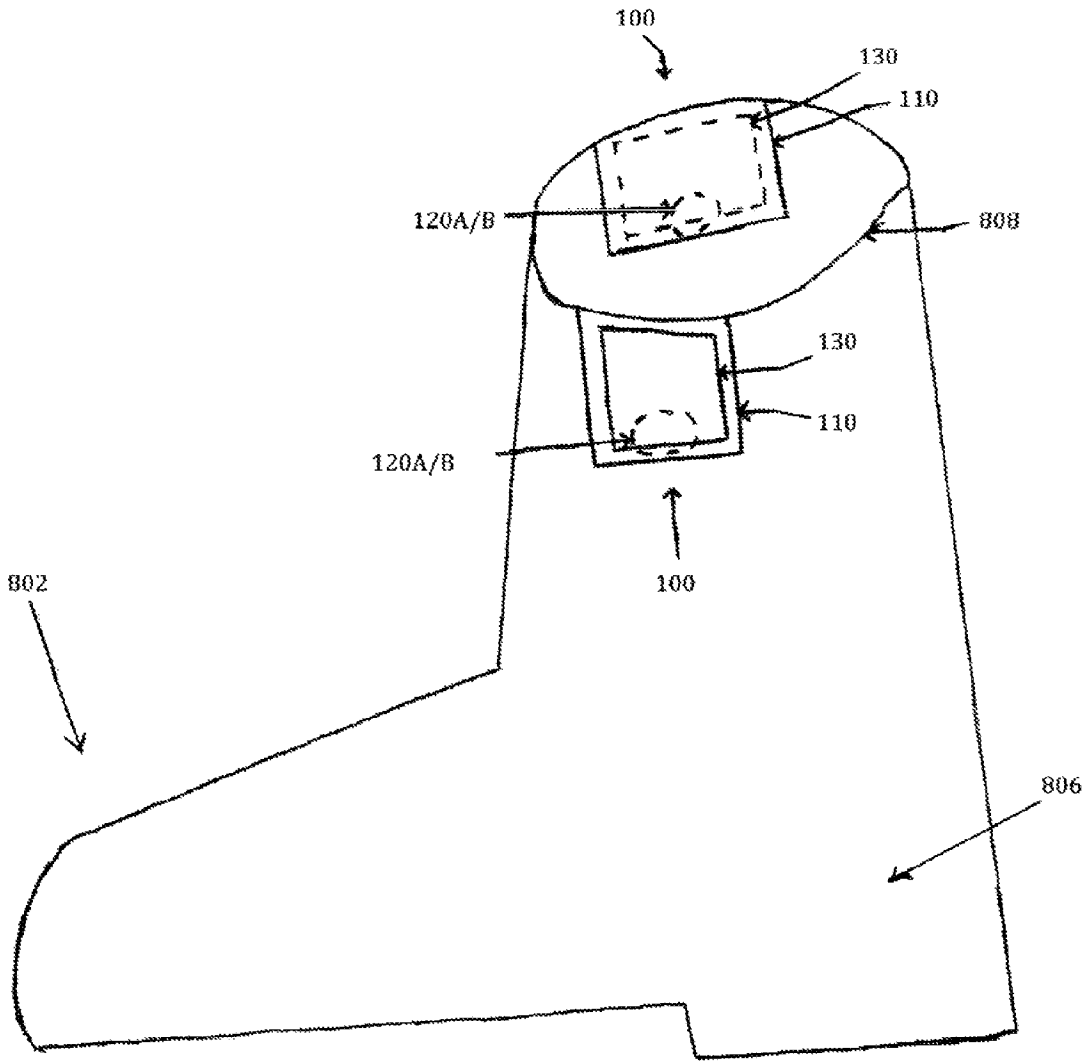
FIG. 8 illustrates an exemplary isometric side view of a two-magnet bendable fastener folded over the upper part of a boot according to certain embodiments.

In certain embodiments, bendable fastener 100 can be used with a typical boot 802 as illustrated in FIG. 8. Usually, the design of boot 802 is fixed and not changeable. This can limit the usability of boot 802 and limit its ability to match or be worn with some fashionable outfits. However, bendable fastener 100 can be used in order to fasten a decorative portion 700 (see FIG. 10) to boot 802, allowing boot 802 to be worn with varying outfits or to be changed for the same outfit. Also, it is to be understood that the use of bendable fastener 100 is not limited to boots, but can be used with apparel in general, including a pair of fashion shoes or pants, shirt collars, coat lapels, pockets, belts, hats or sleeves. In fact, the uses for the items described herein are only limited by the imagination of all potential users of the items (e.g., an equestrian user might use certain embodiment herein to decorate a bridle or saddle), which are too numerous to list in this application, and all such variations are meant to be within the scope of this application.

In FIG. 8, bendable fastener 100 is folded over an upper part 808 of boot 802, so that magnets (120A and 120B) of bendable fastener 100 couple with each other through boot 802. By folding over bendable fastener 100, adhesive piece 130 faces outward (away from an exterior 806 of boot 802).

Figure 2:
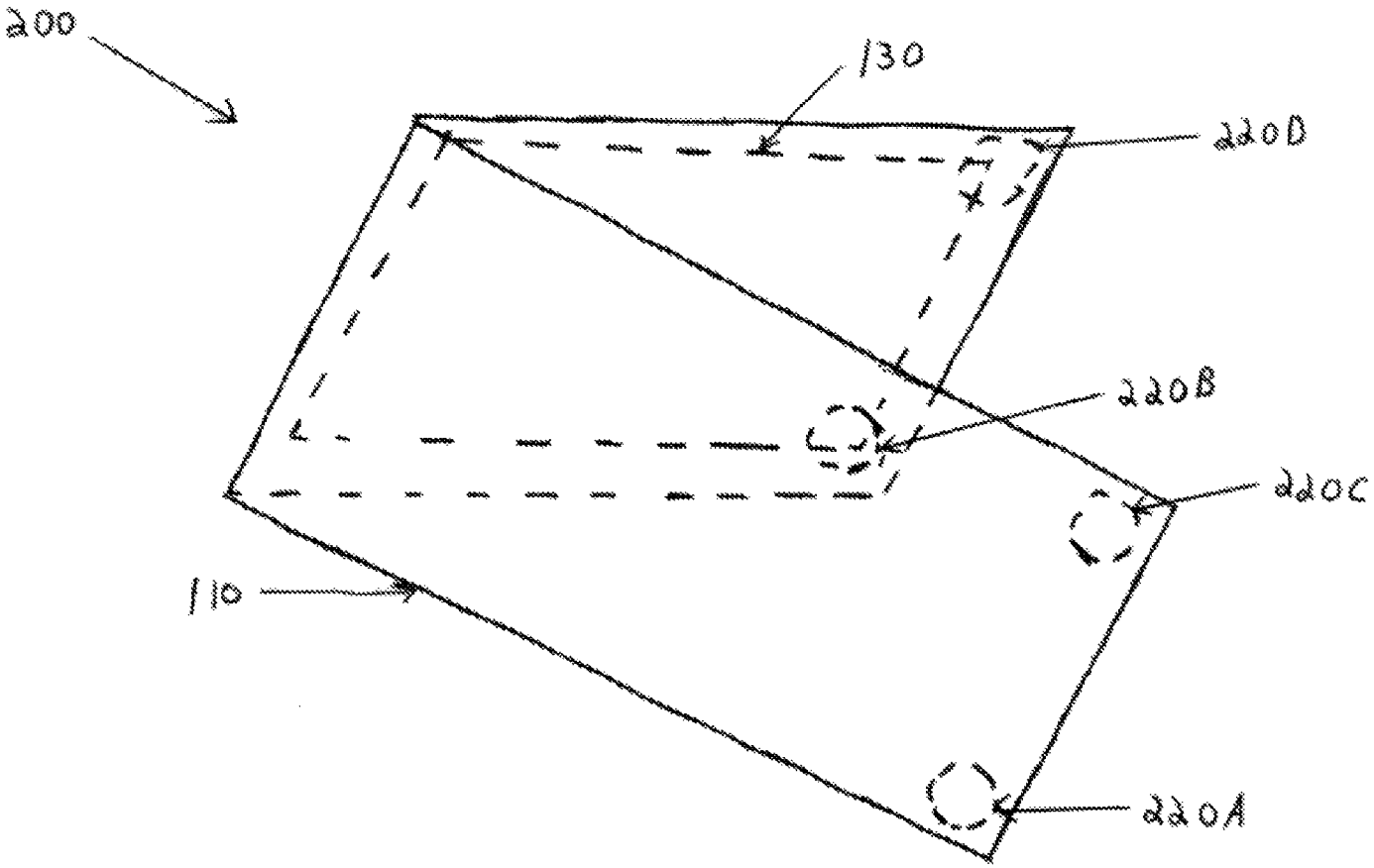
FIG. 2 illustrates an exemplary isometric view a four-magnet bendable fastener according to certain embodiments.
Figure 12:
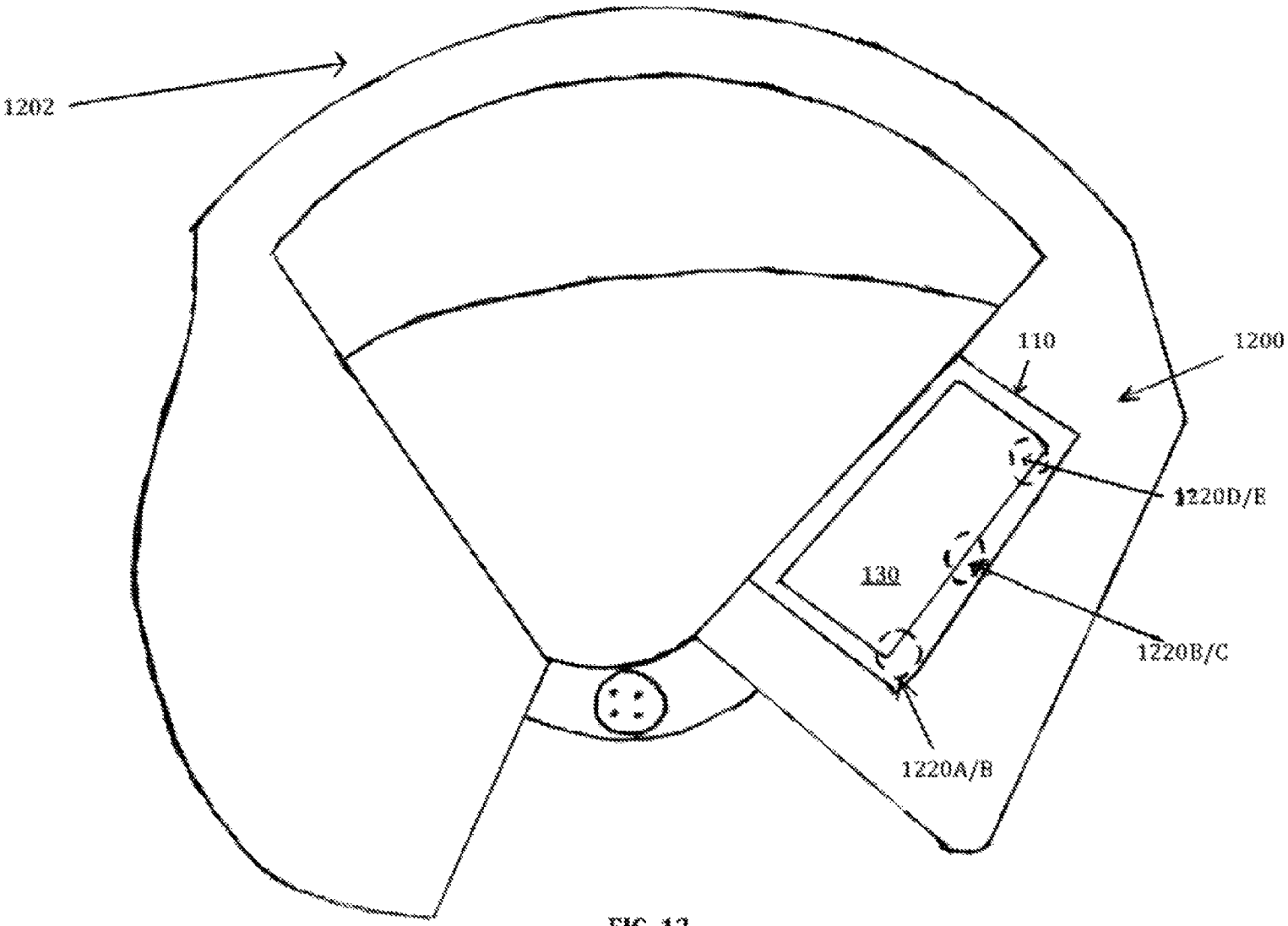
FIG. 12 illustrates an exemplary isometric view of a six-magnet bendable fastener applied to a shirt collar according to certain embodiments.

FIG. 2 illustrates an exemplary isometric view of a four-magnet bendable fastener 200 according to certain embodiments. As shown in FIG. 2, bendable fastener 200 can be generally similar to bendable fastener 100, with multiple magnets 220A, 220B, 220C, 220D near the ends of bendable fastener 200, instead of two magnet 120A and 120B near each end of bendable fastener 100. Bendable fastener 200 can be made of the same material 110 of bendable fastener 100; however, bendable fastener 200 can be made of a different material or combination of materials as well, including those listed herein for material 110. Additionally, all magnets of either bendable fastener 100 or bendable fastener 200 could be any size as design constraints might dictate. Further, bendable fastener 200 functions in the same manner, providing the same fastening capabilities as bendable fastener 100 when used in combination with boot 802. Accordingly, bendable fastener 200 functions in the same manner as bendable fastener 100, but bendable fastener 200 could potentially provide more stability due to a larger quantity of magnets or larger surface area covered by the magnets. For example, as illustrated in FIG. 12, if a stronger or wider fastener is desired (perhaps because the thickness or length of a shirt collar 1202), six magnets (1220A, 1220B, 1220C, 1220D, 1220E, and 1220F) could be used near the ends of a bendable fastener 1200, which may provide more stability due to the additional magnetic points that couple together through shirt collar 1202. However, as explained elsewhere herein, it is to be understood that the number, size, and strength of any magnets, as well as the dimensions of any fastener can vary, and should not be limiting.

Figure 3:
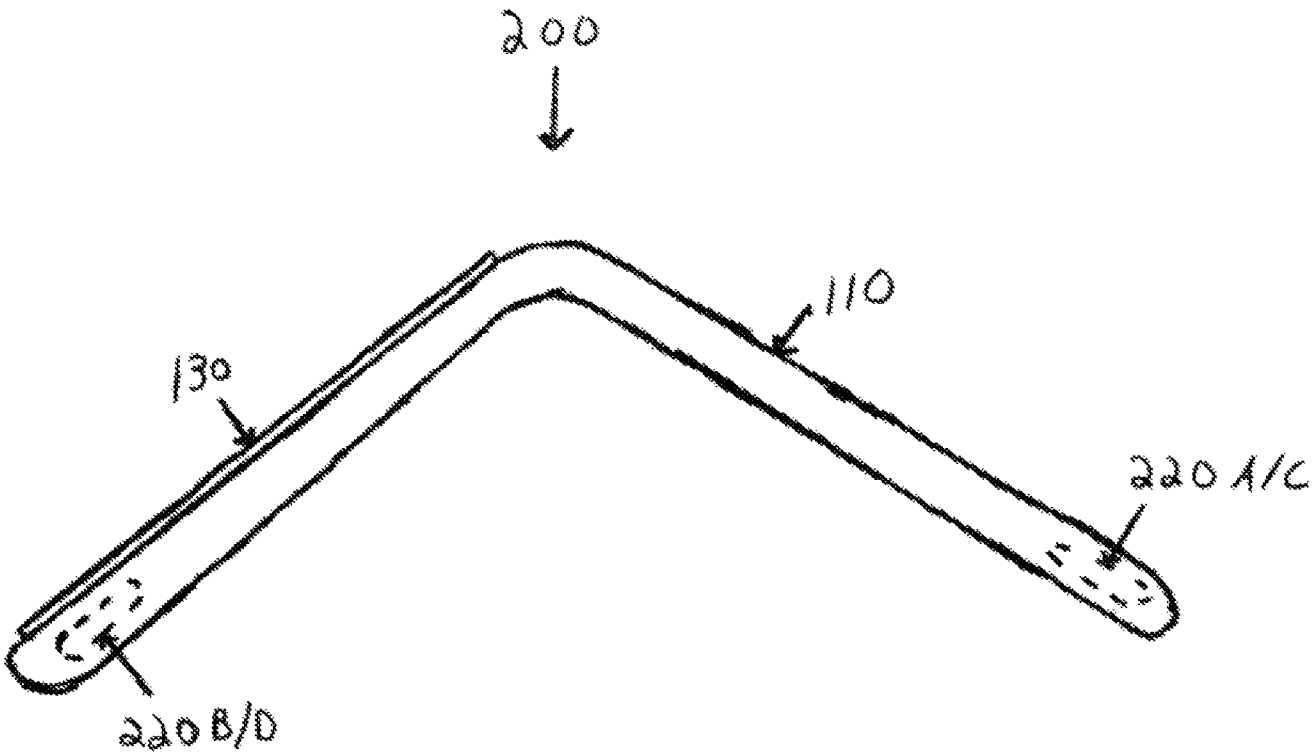
FIG. 3 illustrates an exemplary side view of a four-magnet bendable fastener according to certain embodiments.

FIG. 3 illustrates an exemplary side view of four-magnet bendable fastener 200 or FIG. 2 according to certain embodiments. In FIG. 3, bendable fastener 200 is slightly folded to illustrate how it would fold over upper part 808 of boot 802.

Figure 4:
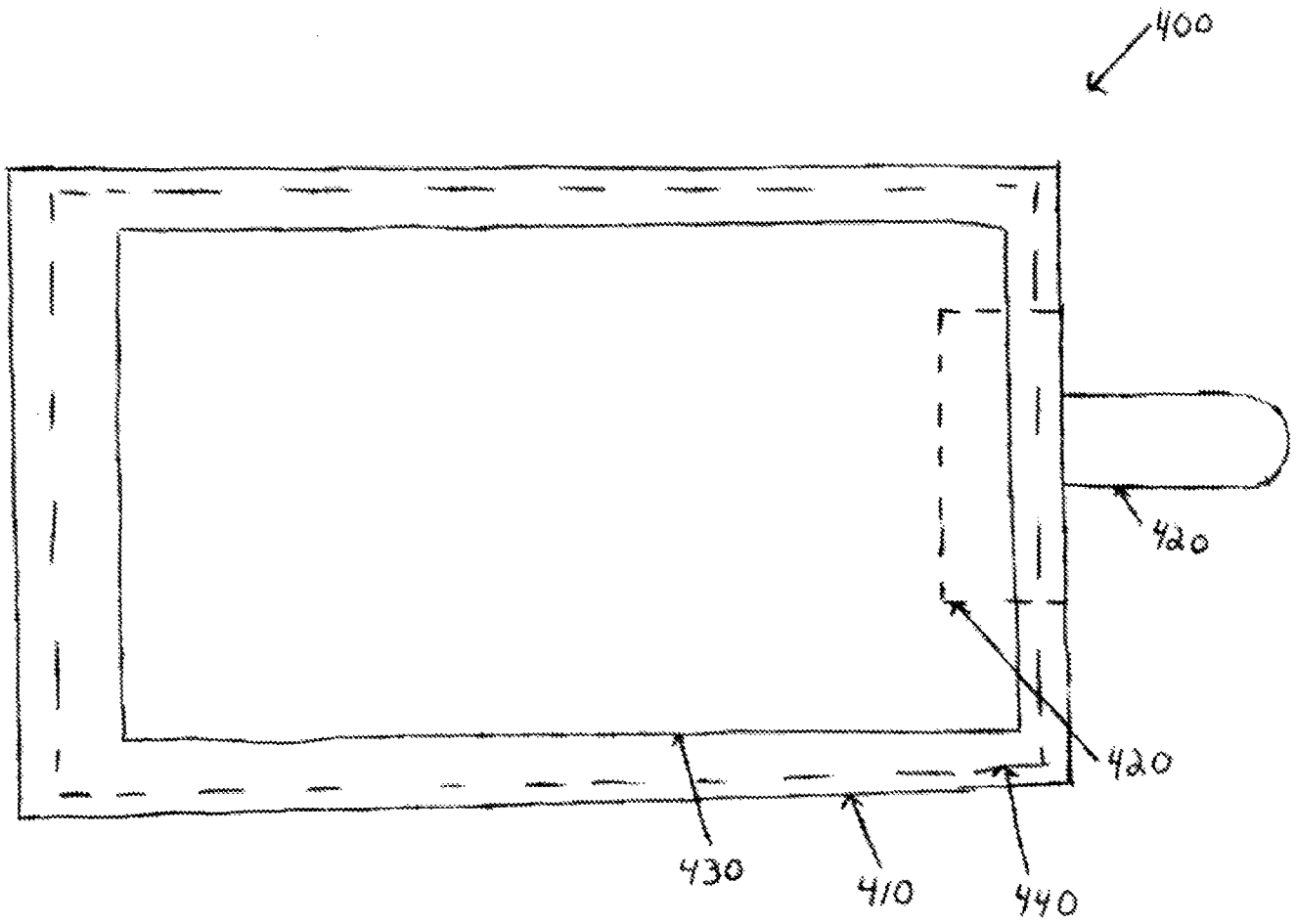
FIG. 4 illustrates an exemplary side view of a single-clip fastener according to certain embodiments.

FIG. 4 illustrates an exemplary side view of a single-clip fastener 400 according to certain embodiments. As shown in FIG. 4, fastener 400 can include a material 410, which can be the same as material 110; however, material 410 can also be made of a different material(s), including those listed herein for material 110. Also, fastener 400 includes an adhesive piece 430 attached to one side of fastener 400 and a single clip 420 connected near one end of fastener 400. Adhesive piece 430 can be the same type as adhesive piece 130, but can also be a different adhesive, including those listed herein for adhesive piece 130. Further, adhesive piece 430 can vary in size and orientation. Clip 420 can be any type of clip, including a shoe clip, paper clip, or a hair clip; as well as vary in size, strength, and orientation. Also, fastener 400 can have other certain embodiments that incorporate more than one clip, as explained elsewhere herein.

In certain embodiments, clip 420 can be positioned on any fastener, so that it folds over upper part of a boot or shoe like a hinge. Additionally, any fastener described herein can include any combination of both clips and magnets. Clip 420 can be metal or custom manufactured.

In certain embodiments, fastener 400 can include a material 440 that can be incorporated inside of fastener 400, if needed, in order to potentially provide more rigidity or stability. However, material 440 can also be excluded and should not be limiting. Further, the orientation and dimensions of material 440 can vary.

Figure 5:
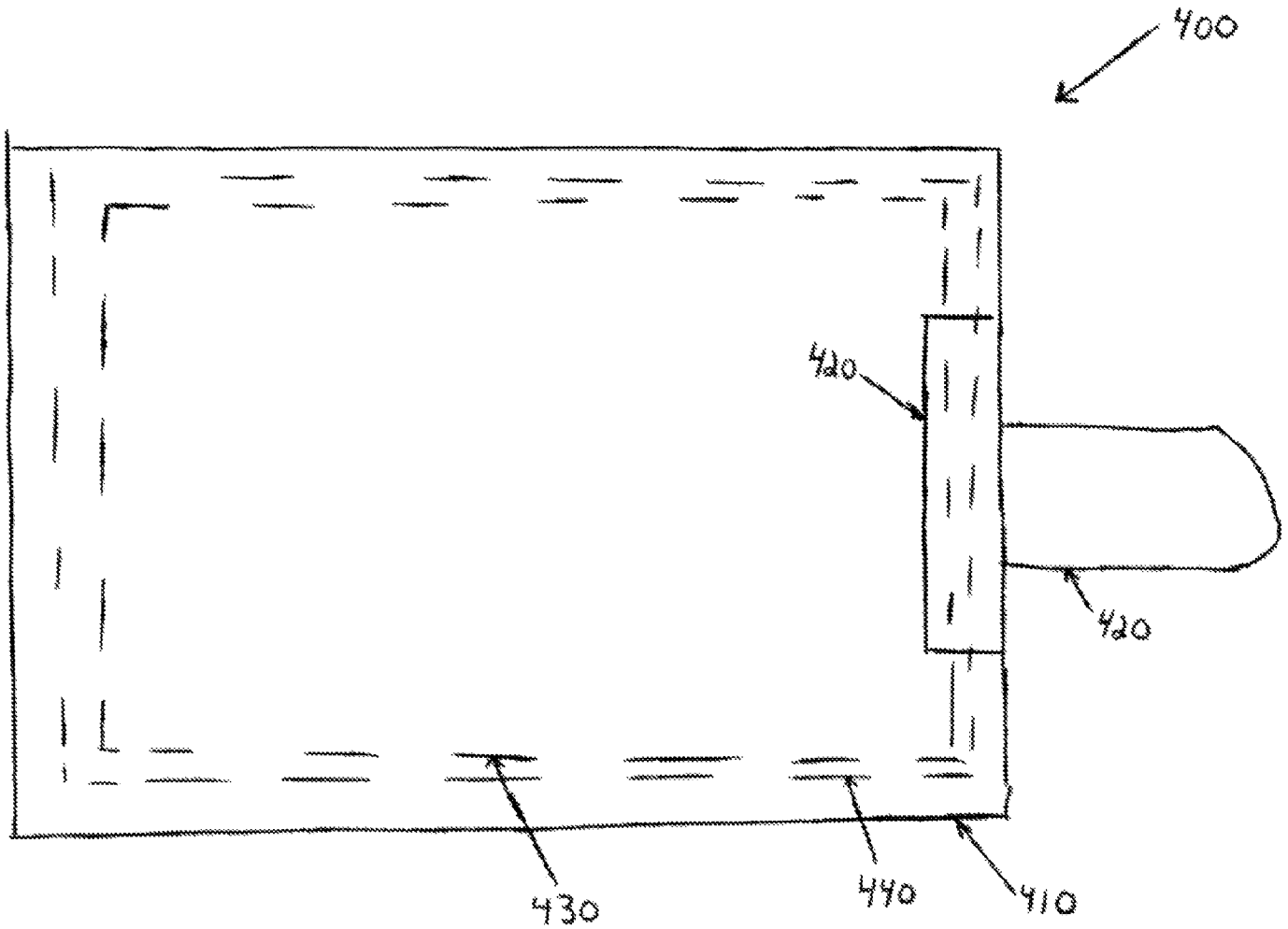
FIG. 5 illustrates an exemplary side view of the opposite side of the FIG. 4 fastener according to certain embodiments.

FIG. 5 illustrates an exemplary side view of the opposite side of fastener 400 or FIG. 4 according to certain embodiments. All reference numbers in FIG. 5 refer to the same reference numbers used in FIG. 4.

Figure 9:
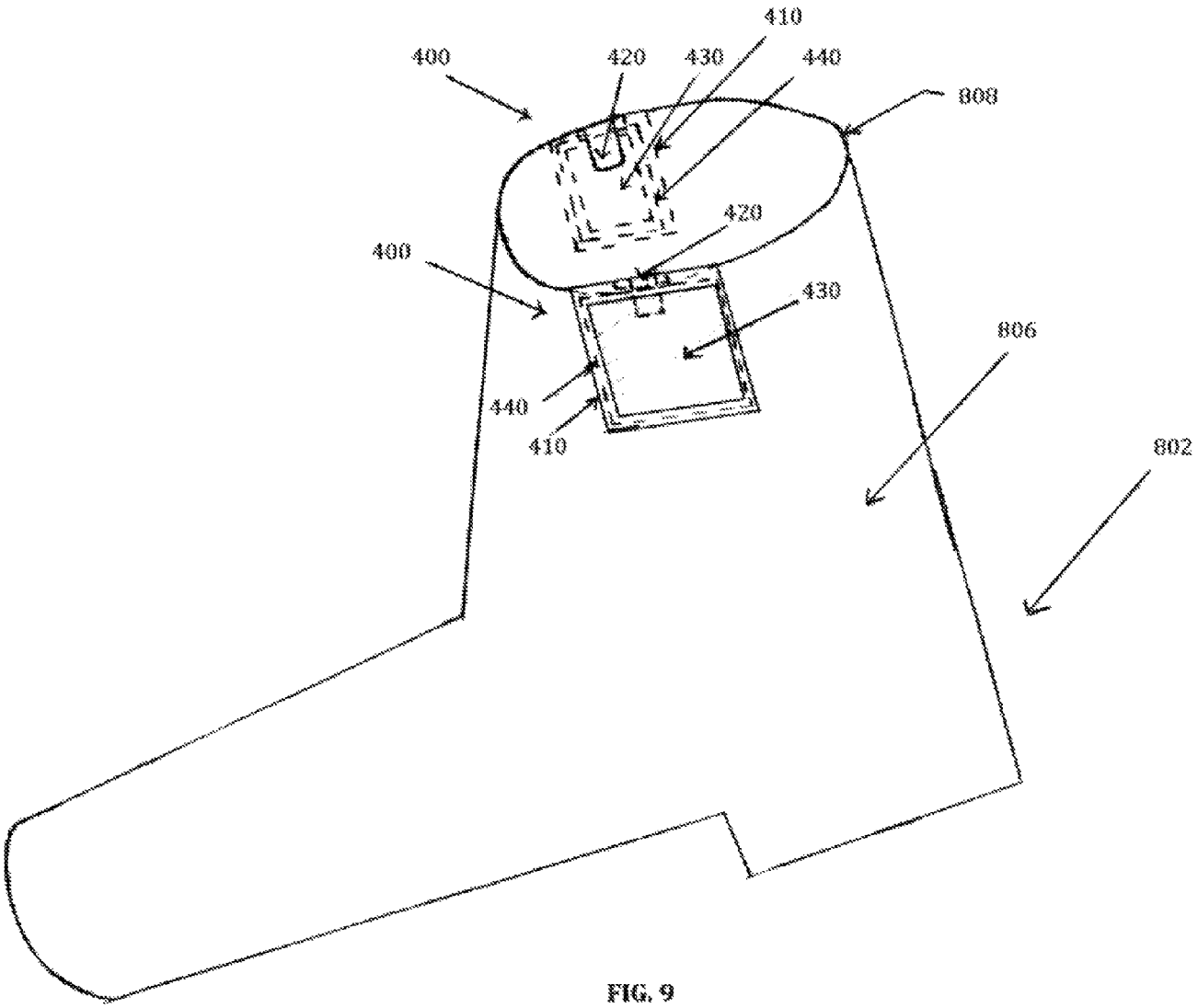
FIG. 9 illustrates an exemplary isometric side view of a single-clip fastener attached to a boot according to certain embodiments.

In FIG. 9, fastener 400 is clipped to upper part 808 of boot 802. Fastener 400 can be clipped to upper part 808 of boot 802 by opening clip 420, sliding clip 420 down upper part 808 of boot 802, and then pressing clip 420 to close. By clipping fastener 400 to boot 802, adhesive piece 430 faces outward (away from exterior 806 of boot 802).

Figure 6A:
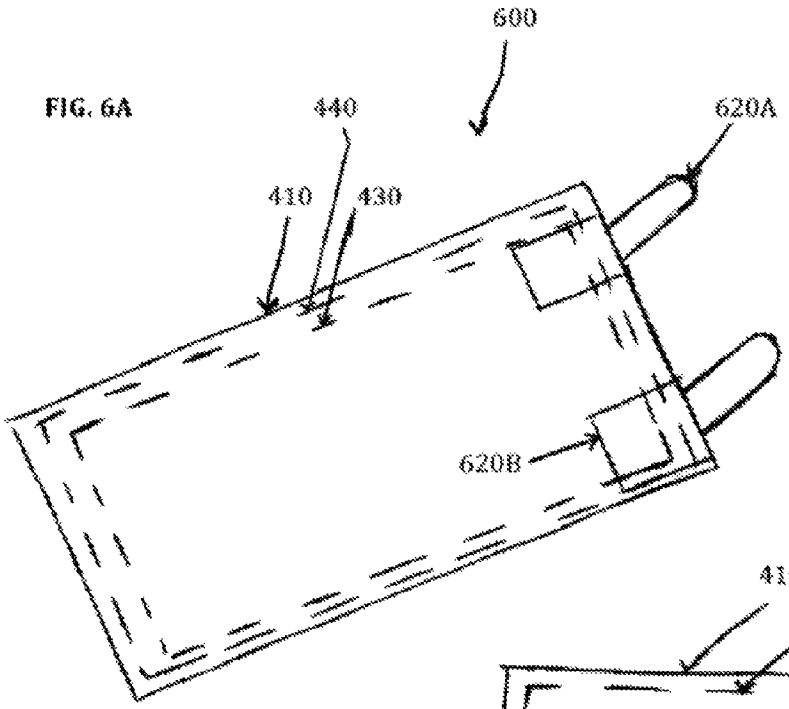
FIG. 6A illustrates an exemplary isometric side view of a two-clip fastener according to certain embodiments.
Figure 6B:
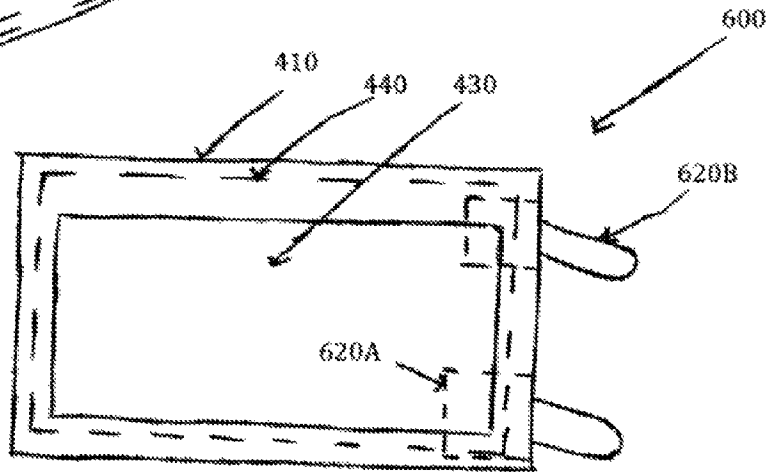
FIG. 6B illustrates an exemplary isometric side view of the opposite side of the FIG. 6A two-clip fastener according to certain embodiments.

FIGS. 6A and 6B illustrate exemplary views of each side of a two-clip fastener 600 according to certain embodiments. As shown in FIGS. 6A and 6B, fastener 600 can be generally similar to fastener 400, except with multiple clips (620A and 620B) near an end of fastener 600 (instead of a single clip 420 of fastener 400). Fastener 600 can be made of material 410, but can also be any made of any other material or combination of materials, including those listed herein for material 110. Additionally, all clips of either fastener 400 or fastener 600 could be any size as design constraints might dictate. Further, fastener 600 can function in the same manner, providing the same fastening capabilities as fastener 400 when used in combination with boot 802. However, fastener 600 could potentially provide more stability due to the use of additional clips, or by combining with at least one magnet, preventing a pivot point potentially encountered with fastener 400.

Figure 7A:
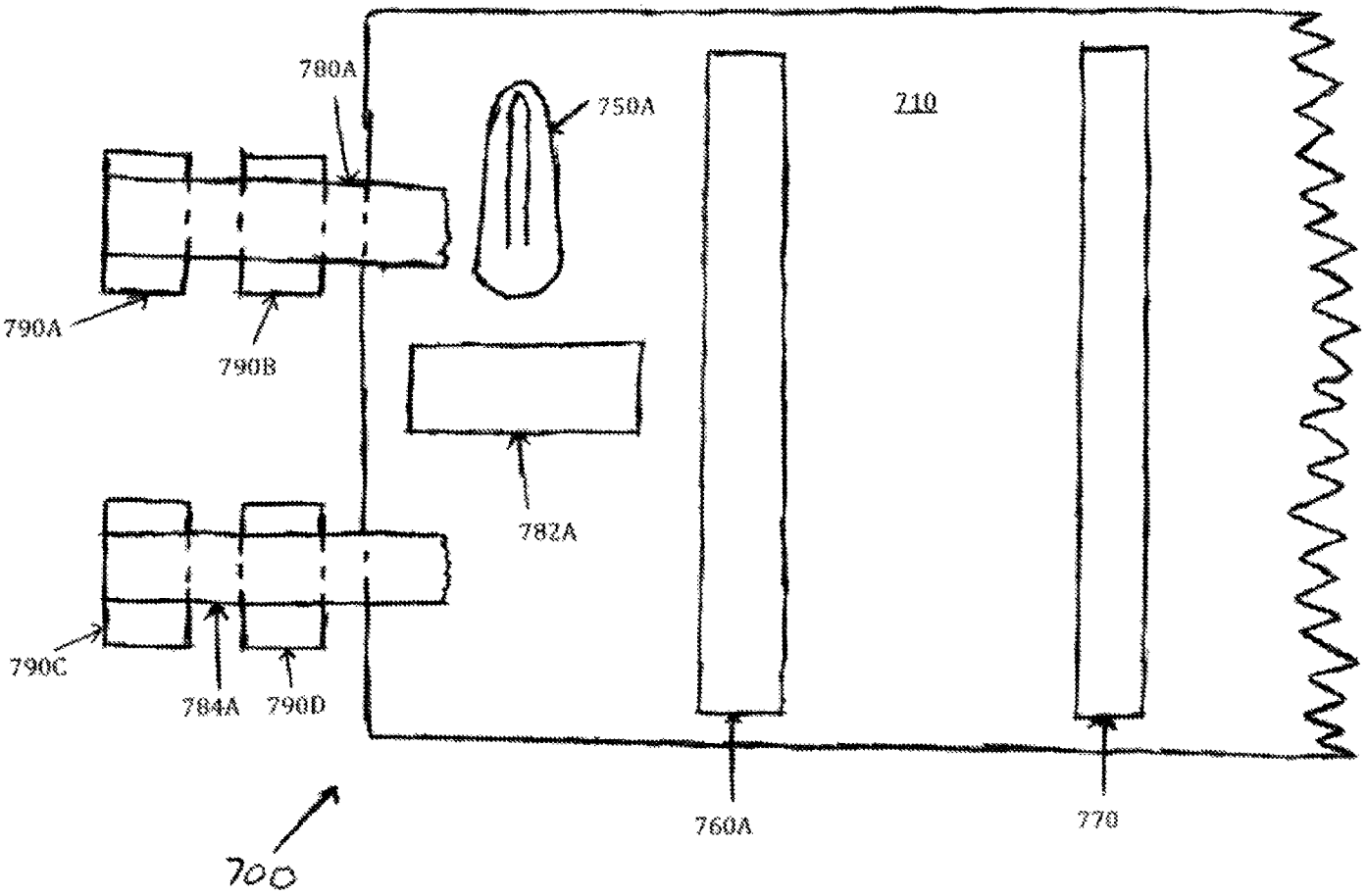
FIG. 7A illustrates an exemplary cut-away side view of the left half of a decorative portion according to certain embodiments.
Figure 7B:
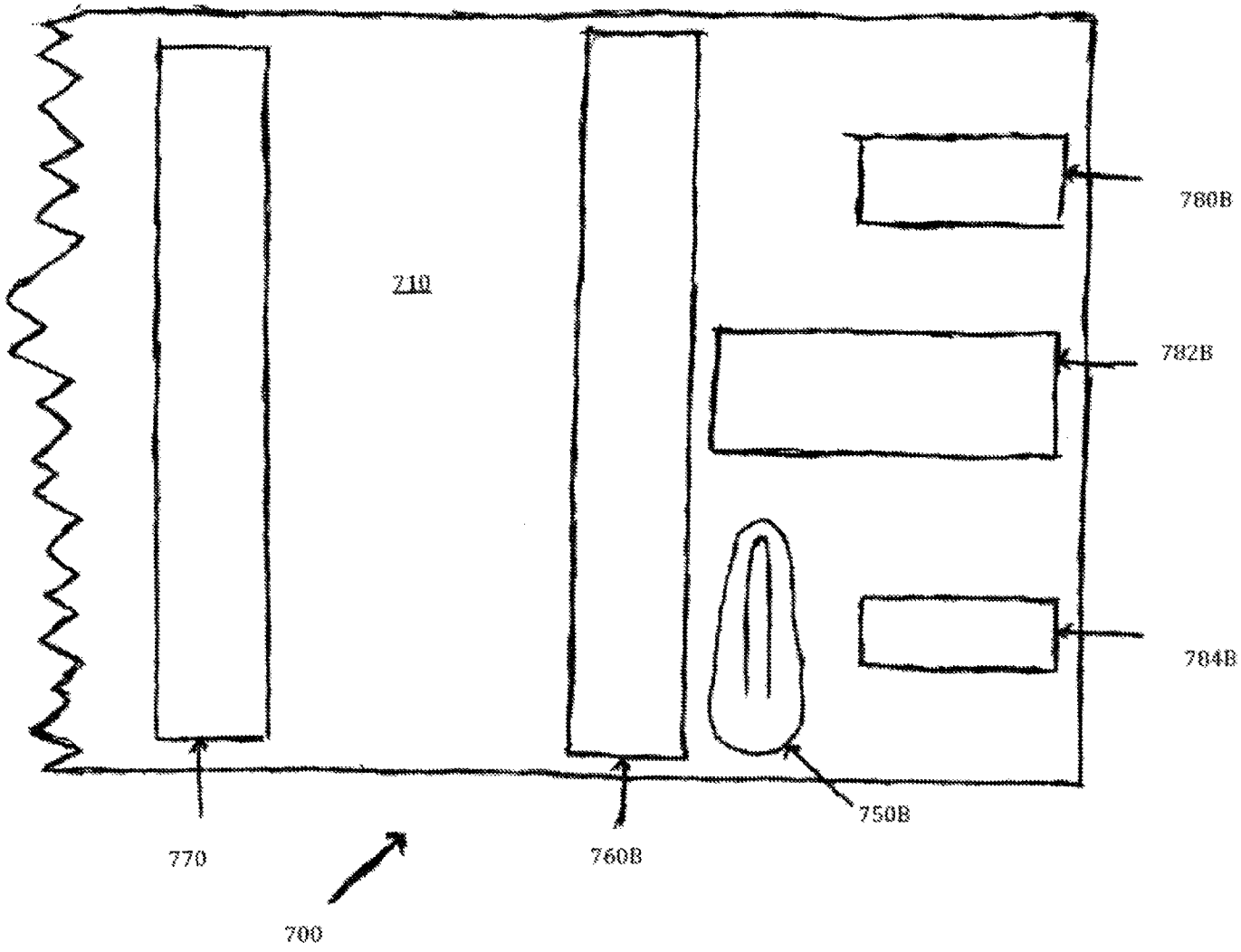
FIG. 7B illustrates an exemplary cut-away side view of the right-half of the FIG. 7 decorative portion according to certain embodiments.
Figure 10:
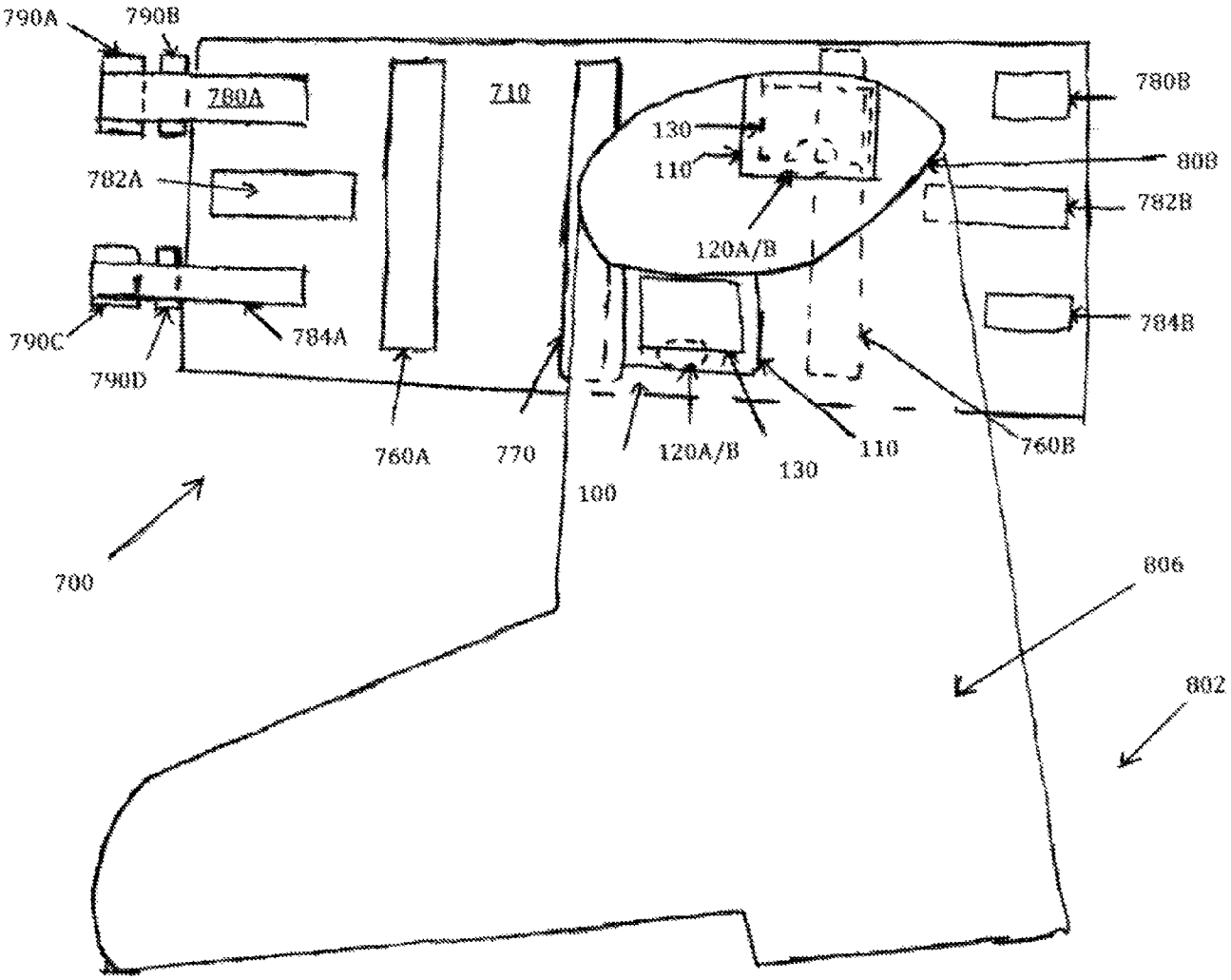
FIG. 10 illustrates an exemplary isometric side view of a decorative portion connected to a boot, using two two-magnet bendable fasteners according to certain embodiments.

FIGS. 7A and 7B illustrate an exemplary side view of decorative portion 700 according to certain embodiments. As shown in FIGS. 7A and 7B, decorative portion 700 can include a hook 750A near the top-left section of decorative portion 700 or a hook 750B near the bottom-right section of decorative portion 700, either supplementing or substituting any fasteners used; that is, either potentially providing more stability (if used with any fasteners) or simply fastening decorative portion 700 to boot 802 (if used without any fasteners). Accordingly, it is to be understood either the inclusion or exclusion of hooks (750A and/or 750B) are not to be limiting. In FIG. 10, if used, hooks (750A and 750B) fit over upper part 808 of boot 802. Further, if hooks (750A and/or 750B) are used alone (without any kind of fasteners), the ability to adjust the height or position of decorative portion 700 could be limited since hooks (750A and/or 750B) can remain in a fixed position on decorative portion 700. Additionally, hooks (750A and 750B) can vary in size, orientation, or position as design constraints might dictate and can be any type of hook or clip, including those mentioned for clip 420.

In FIGS. 7A and 7B, decorative portion 700 can include a left-aligned vertical adhesive strip 760A, a center-aligned vertical adhesive strip 770, and a right-aligned vertical adhesive strip 760B. Vertical adhesive pieces (760A, 770, and 760B) can be the same type as adhesive piece 130, but can also be a different adhesive, including those listed herein for adhesive piece 130. Further, the orientation and size of vertical adhesive strips (760A, 770, and 760B) can vary as design constraints might dictate. In FIG. 10, decorative portion 700 is attached to boot 802 using bendable fastener 100 positioned on upper part 808 of boot 802 with adhesive piece 130 outwardly exposed, coupling with vertical adhesive strip 760B of decorative portion 700. One can then reposition the other fastener 100, aligning it with one of the other vertical adhesive strips (760A or 770). Further, one can adjust the height or position of decorative portion 700 on boot 802 by positioning adhesive pieces 130 of fastener 100 higher or lower on vertical adhesive strips (760A, 770, and 760B). By coupling adhesive piece 130 of fastener 100 with vertical adhesive strips (760A, 770, or 760B) of decorative portion 700, decorative portion 700 is prevented from slipping down boot 802. In certain embodiments, decorative portion 700 can include more or less vertical adhesive strips. Additionally, any amount of any fasteners or bendable fasteners can be used in combination with the vertical adhesive strips.

In FIGS. 7A and 7B, decorative portion 700 also can include a right horizontal top-aligned adhesive strip 780B, a right horizontal bottom-aligned adhesive strip 784B, a left horizontal top-aligned elastic strip 780A and a left horizontal bottom-aligned elastic strip 784A. As shown in FIG. 7A, left horizontal top-aligned elastic strip 780A can include an adhesive piece 790A and an adhesive piece 790B. Additionally, left horizontal bottom-aligned elastic strip 784A can include an adhesive piece 790C and an adhesive piece 790D. Adhesive pieces (790A, 790B, 790C, 790D) and adhesive strips (780B and 784B) can be the same type as adhesive piece 130, but can also be a different adhesive, including those listed herein for adhesive piece 130. Elastic strips (780A and 784A) can be of any material that is at least partially elastic, including Nylon®, Tactel® Nylon®, Micro Nylon®, Microdenier Nylon®, microfiber, spandex, Lycra®, Lycra® spandex, polyester, cotton, acetate, rayon, viscose, or chenille. Further, the orientation and size any adhesive or elastic pieces or strips can vary as design constraints might dictate. In FIG. 10, one can connect the two ends of decorative portion 700 together by wrapping decorative portion 700 around upper part 808 of boot 802. The ends of decorative portion 700 can be connected by coupling adhesive pieces (790A and/or 790B) of left horizontal top-aligned elastic strip 780A with right horizontal top-aligned adhesive strip 780B and also coupling adhesive pieces (790C and/or 790D) of left horizontal bottom-aligned elastic strip 784A with right horizontal bottom-aligned adhesive strip 784B. By connecting the ends of decorative portion 700 around boot 802, decorative portion 700 is prevented from unwrapping.

Figure 11A:
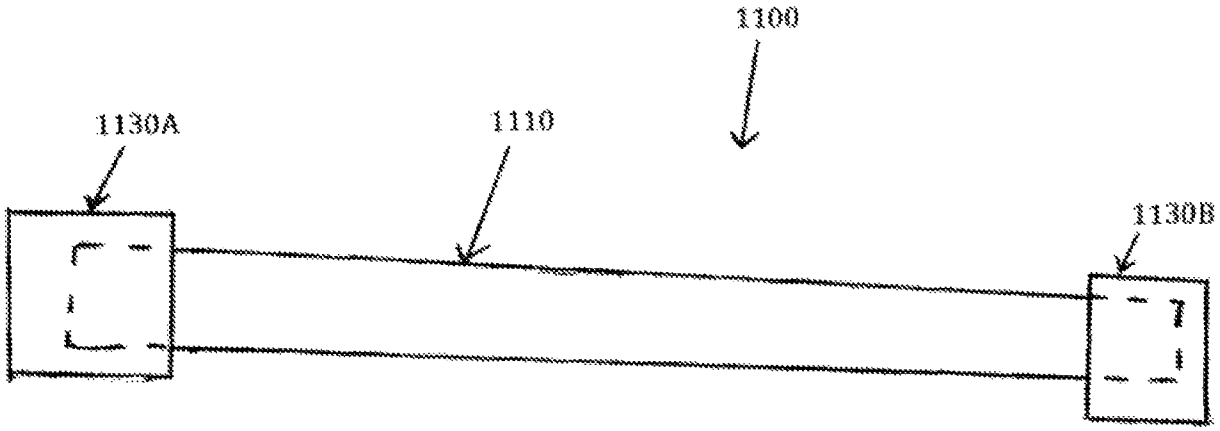
FIG. 11A illustrates an exemplary side view of a removable ribbon according to certain embodiments.
Figure 11B:
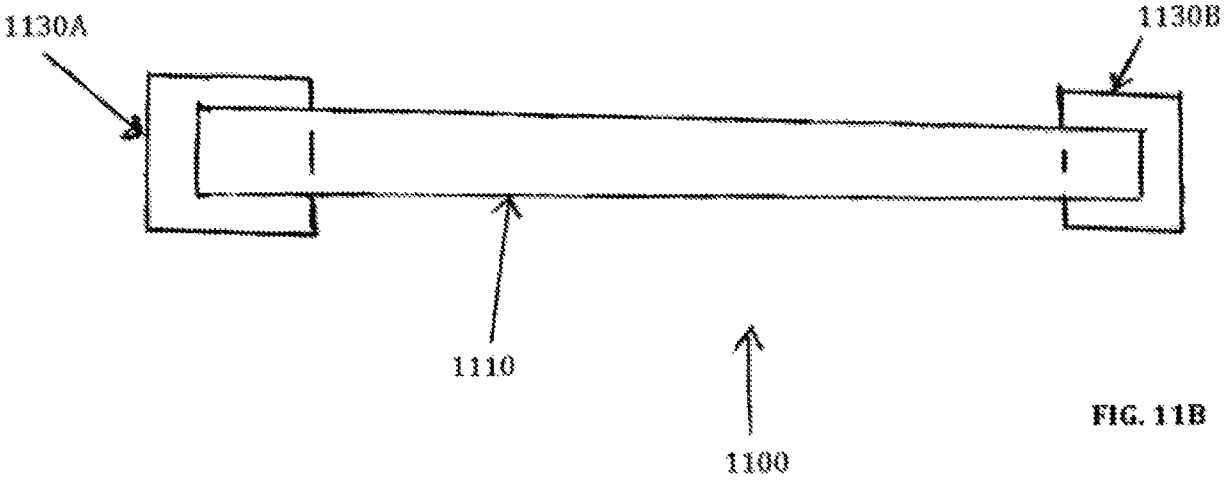
FIG. 11B illustrates an exemplary side view of the opposite side of the FIG. 12A removable ribbon according to certain embodiments.

FIGS. 11A and 11B illustrate exemplary side views of both sides of a removable ribbon 1100 according to certain embodiments. As shown in FIGS. 11A and 11B, ribbon 1100 can include a material 1110 and an adhesive piece (1130A and 1130B) near both ends. Material 1110 can be the same kind of material as material 110, but can also be made of different materials, including those listed herein for material 110. Adhesive pieces (1130A and 1130B) can be the same type as adhesive 130, but can also be a different adhesive, including those listed herein for adhesive piece 130. Ribbon 1100 can be added to decorative portion 700, if desired, by coupling adhesive pieces (1130A or 1130B) to a left adhesive strip 782A and a right adhesive strip 782B of decorative portion 700. If the removable ribbon 1100 is used, it can be tied into a bow or any other stylish form. In FIGS. 7A and 7B, left and right adhesive strips (782A and 782B) can be the same type as adhesive 130, but can also be a different adhesive, including those listed herein for adhesive piece 130.

Figure 13B:
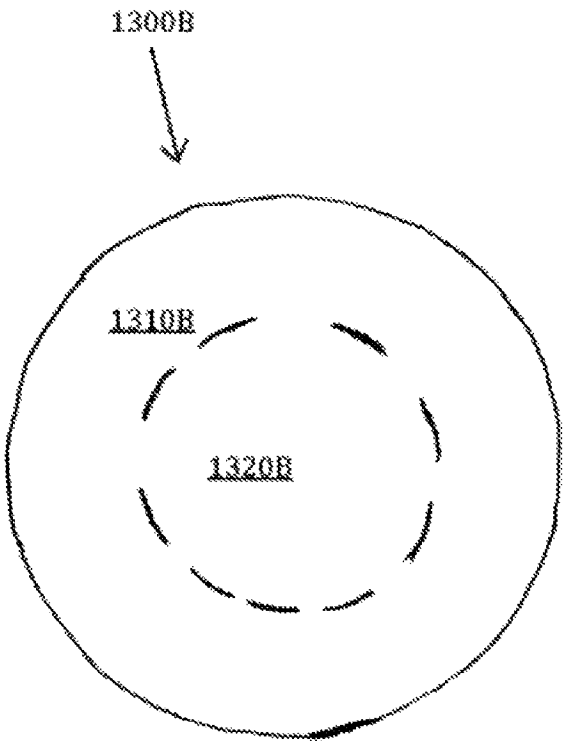
FIG. 13B illustrates an exemplary side view of a magnetic button according to certain embodiments.
Figure 13A:
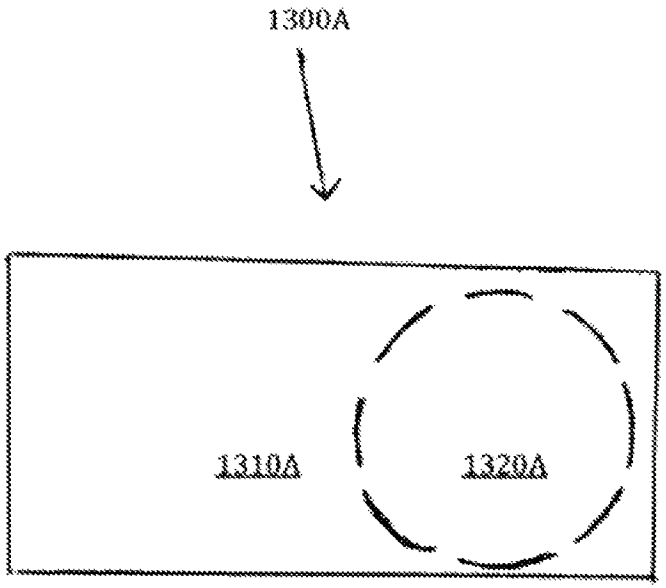
FIG. 13A illustrates an exemplary side view of a single-magnet segment according to certain embodiments.

FIG. 13A illustrates an exemplary side view of a single-magnet segment 1300A according to certain embodiments. As shown in FIG. 13A, segment 1300A can include a material 1310A and a magnet 1320A. Material 1310A can be the same material 110; however, material 1310A can be made of a different material or combination of materials, including those listed herein.

FIG. 13B illustrates an exemplary side view of a magnetic button 1300B according to certain embodiments. As shown in FIG. 13B, magnetic button 1300A can include a button 1310B and a magnet 1320B. Magnets (1320A and 1320B) can be the same type as magnet 120A, but can also be a different magnet, including those listed herein for magnet 120A. Additionally, all magnets of either segment 1300A or magnetic button 1300B could be any size as design constraints might dictate. Moreover, one of magnets 1320A and 1320B could be replaced with a piece of magnetic material, such as a magnet metal.

Figure 14:
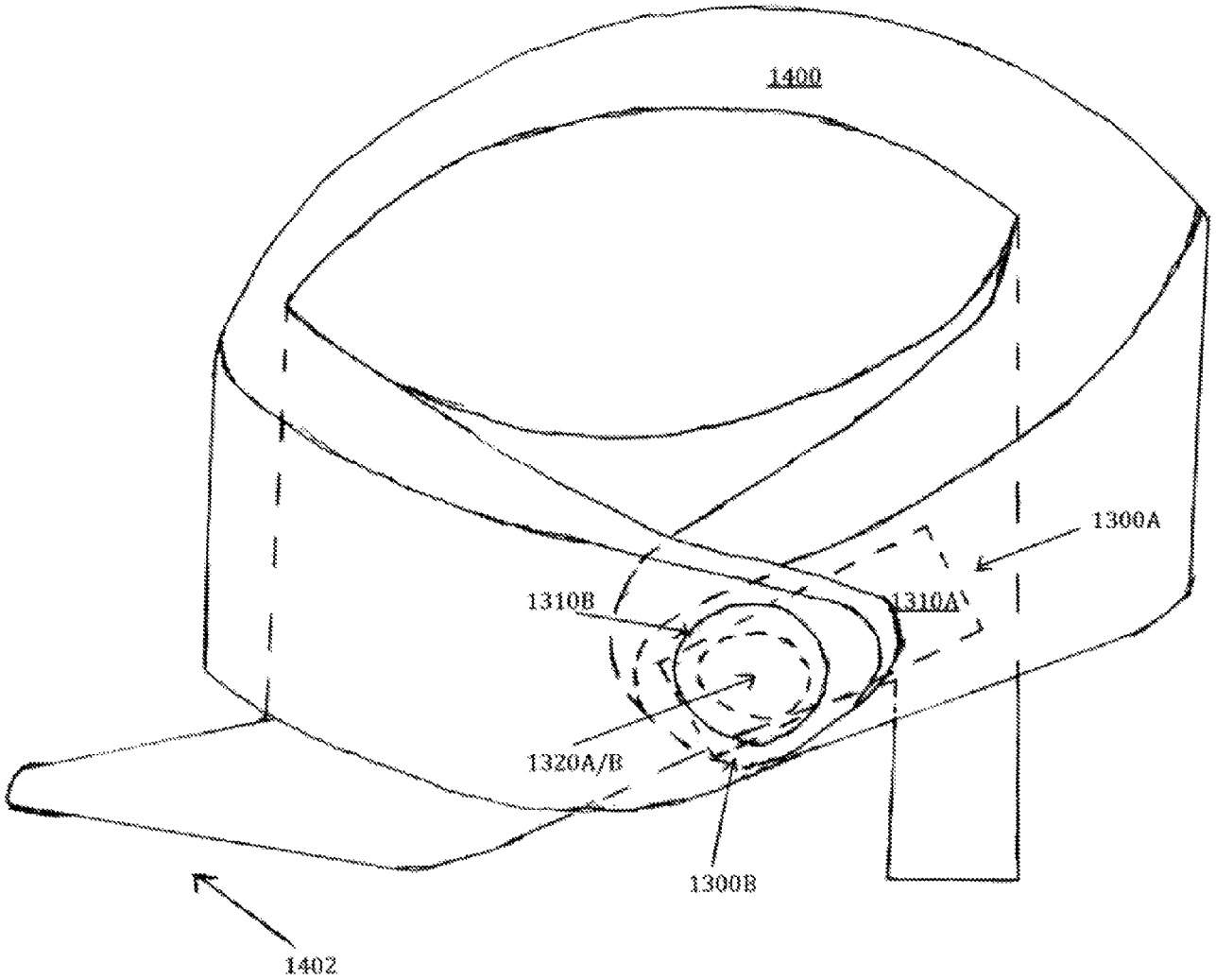
FIG. 14 illustrates an exemplary isometric side view of a decorative portion applied to a boot using a single-magnet segment and a magnetic button according to certain embodiments.

In FIG. 14, segment 1300A couples to magnetic button 1300B, through a decorative portion 1400, keeping decorative portion 1400 from unwrapping around a boot 1402. As shown in FIG. 14, decorative portion 1400 can be generally similar to decorative portion 700. In FIG. 14, segment 1300A couples to magnetic button 1300B through decorative portion 1400, connecting the ends of decorative portion 1400 using magnets (1320A and 1320B) (instead of using adhesive pieces and strips (790A, 790B, 790C, 790D, 780B, and 784B), and elastic strips (780A and 784A) of decorative portion 700 to connect it). Additionally, the outside of decorative portion(1400 is an ornamental design that can include a variety of decorations known to those skilled in the art, including fur, beads, lace, bangles, feathers, stones, rhinestones or any other decoration. However, as stated previously, it is understood that many decorations could be used alone or in combination. Furthermore, the size, length, and width of at least one decoration, as well as the size, length, and width of decorative portion 1400 can be varied to further provide different appearance (covering more or less of a general article of apparel). By owning several styles of decorative portion 1400, one could have several different looks with a single article of apparel, such as a pair of fashion shoes or pants, shirt collars, coat lapels, pockets, belts, hats or sleeves. In fact, the uses for the items described herein are only limited by the imagination of all potential users of the items, which are too numerous to list in this application, and all such variations are meant to be within the scope of this application. This provides a simple, cost effective way to change looks.

In certain embodiments, any clips, magnets, adhesive pieces or strips, or elastic strips, mention herein can be connected to any fastener, bendable fastener, or decorative portion by any means, including sewing, pinning, or the use of adhesives such as glue or tape.

What is claimed is:

1. An apparatus to accessorize boots comprising:

i) a removable bendable fastener comprising at least one magnet integrally attached near at least one end of the removable bendable fastener, wherein the removable bendable fastener further comprises a front side, the front side having an adhesive piece, wherein the adhesive piece is outwardly directed when the removable bendable fastener is folded over the boots; and a back side, the back side having a material; and ii) a decorative portion that removably attaches to the removable bendable fastener, wherein the decorative portion comprises an exposed side, the exposed side having an ornamental design, and an inside, the inside having at least one adhesive strip;

wherein the ornamental design is a decoration that is outwardly directed when the decorative portion is connected to the removable bendable fastener;

wherein the adhesive strip is positioned such that the adhesive strip of the decorative portion can secure to the adhesive piece of the removable bendable fastener;

wherein the decorative portion comprises at least one hook to provide stability;

wherein at least one clip is incorporated with the bendable fastener to provide stability for a heavy decorative portion; and wherein the decorative portion comprises:

i) a right horizontal top-aligned adhesive strip, ii) a right horizontal bottom-aligned adhesive strip, iii) a left horizontal top-aligned elastic strip; and iv) a left horizontal bottom-aligned elastic strip;

wherein the decorative portion comprises two ends, wherein the two ends of the decorative portion can be wrapped around an upper part of the boot by coupling adhesive pieces of the left horizontal top-aligned elastic strip with the right horizontal top-aligned adhesive strip; and coupling adhesive pieces of the left horizontal bottom-aligned elastic strip with the right horizontal bottom-aligned adhesive strip.

2. The apparatus of claim 1, wherein the fastener is removably attached to the boots using one pair of magnets, and each of the one pair of magnets is integrally attached near an opposite end of the fastener, such that when the fastener is folded over the boots, the one pair of magnets become coupled.

3. The apparatus of claim 1, wherein the fastener is removably attached to the boots using two pairs of magnets, and at least one magnet of each of the two pairs of magnets is integrally attached near an opposite end of the fastener, such that when the fastener is folded over the boots, the two pairs of magnets become coupled.

4. An apparatus to accessorize boots comprising:

i) a removable bendable fastener comprising two clips integrally attached near two ends of the removable bendable fastener, wherein the removable bendable fastener comprises a front side, the front side having an adhesive piece, wherein the adhesive piece is outwardly directed when the fastener is folded over the boots; and ii) a back side, the back side having a material; and iii) a decorative portion that removably attaches to the fastener, wherein the decorative portion comprises an exposed side, the exposed side having an ornamental design, and an inside, the inside having at least one adhesive strip;

wherein the ornamental design is a decoration that is outwardly directed when the decorative portion is connected to the removable bendable fastener;

wherein the adhesive strip is positioned such that the adhesive strip of the decorative portion can secure to the adhesive piece of the removable bendable fastener; and wherein the decorative portion comprises at least one hook to provide stability; and wherein the decorative portion comprises:

i) a right horizontal top-aligned adhesive strip, ii) a right horizontal bottom-aligned adhesive strip, iii) a left horizontal top-aligned elastic strip; and iv) a left horizontal bottom-aligned elastic strip;

wherein the decorative portion comprises two ends, wherein the two ends of the decorative portion can be wrapped around an upper part of the boot by coupling adhesive pieces of the left horizontal top-aligned elastic strip with the right horizontal top-aligned adhesive strip; and coupling adhesive pieces of the left horizontal bottom-aligned elastic strip with the right horizontal bottom-aligned adhesive strip.

* * * * *